US005618135A

United States Patent [19]

Glass et al.

[11] Patent Number: 5,618,135

[45] Date of Patent: Apr. 8, 1997

[54] PILE THREADING DEVICE FOR CONNECTING SHEET PILES

[75] Inventors: James O. Glass; Sam M. Glass, both of Anahuac, Tex.

[73] Assignee: Stab Cat, Inc., Ananuca, Tex.

[21] Appl. No.: 573,243

[22] Filed: Dec. 15, 1995

[51] Int. Cl.[6] ..... E02D 13/04

[52] U.S. Cl. ..... 405/279; 405/232; 405/274

[58] Field of Search ..... 405/274–281, 405/246, 247, 231, 232, 303

[56] References Cited

U.S. PATENT DOCUMENTS

| | | | |
|---|---|---|---|
| 1,135,448 | 4/1915 | Friddle | 405/274 X |
| 2,074,906 | 3/1938 | Hausler | 405/278 |
| 2,122,835 | 7/1938 | Deros | 405/278 X |
| 2,161,482 | 6/1939 | Miller et al. | 405/276 X |
| 2,355,102 | 8/1944 | Odman | 405/278 |
| 2,583,928 | 1/1952 | Caudill | 405/276 X |
| 2,968,931 | 1/1961 | McGrath | 405/277 X |
| 3,101,956 | 8/1963 | Muller | 173/132 X |
| 3,866,425 | 2/1975 | Morrice | 405/274 |
| 4,028,901 | 6/1977 | Barber | 405/277 |
| 4,083,192 | 4/1978 | Diekman | 405/281 |
| 4,124,987 | 11/1978 | Hallman et al. | 405/276 |
| 4,172,681 | 10/1979 | Hache | 405/232 X |
| 4,189,256 | 2/1980 | Dawson | 405/277 |
| 4,419,030 | 12/1983 | Burkemper | 405/274 X |
| 4,557,630 | 12/1985 | Neil | 405/232 |
| 4,709,764 | 12/1987 | Gibbons | 405/232 X |

*Primary Examiner*—Dennis L. Taylor
*Attorney, Agent, or Firm*—Eugene N. Riddle

[57] ABSTRACT

A pile threading device (14) for threading sheet piles (10, 12) and including a box-type frame or body (20) comprising a plurality of connected frame members. An upper slide (44) is mounted on body (20) for relative sliding movement and has a pair of opposed jaws (54, 56) thereon for clamping or gripping the undriven pile (12) for lifting the threading device (14). A pivoted stop bar (70) on the slide (44) engages a side edge (12C) of the undriven pile (12) when the pile (12) is initially positioned on the slide (44)for accurate positioning of the undriven pile (12) on the slide (44). One of the jaws (56) is held in a predetermined fixed relation by an adjustable nut (66) which is positioned at a predetermined position on externally threaded shaft (60) mounting the jaw (56). Roller frames (29, 30) carry rollers (32) for engaging opposed sides of the driven pile (10). One roller frame (30) is mounted for sliding movement on shaft (34) against compression spring (38) to provide a cushioned movement of frames (29, 30) away from each other.

12 Claims, 4 Drawing Sheets

PILE THREADING DEVICE FOR CONNECTING SHEET PILES

FIELD OF THE INVENTION

This invention relates to a pile threading device for connecting an undriven pile to a driven sheet pile in an interlocked side by side relation. More particularly, the invention relates to such a pile threading device which is lifted by the undriven sheet pile into a raised position for threading or stabbing the side edge of the undriven pile onto the vertically aligned subjacent side edge of the driven pile.

BACKGROUND OF THE INVENTION

As well known, sheet metal piles are driven by a pile driver at a construction site into the ground or the bottom of a body of water, such as a stream or bay, for example. The sheet metal piles normally are of a channel or Z-shape in cross section and adjacent piles are interlocked to prevent separation of the driven piles thereby to provide a continuous wall. Adjacent side edges of adjacent piles interfit in an interlocking relation and the undriven raised pile must be vertically aligned with the adjacent driven pile for subsequent threading or stabbing to form the interlocking relation.

Heretofore, such as shown in U.S. Pat. No. 5,407,304 dated Apr. 18, 1995, a sheet pile threading device has been provided which is lifted by the undriven pile into a raised position for threading the lower end of the undriven pile onto the vertically aligned upper end of the driven pile while in a side by side relation.

After the lower end of the undriven pile clears the upper end of the driven pile, a workman at ground level actuates a laterally movable slide on the pile threading device to move the upper undriven pile laterally into a vertically aligned position with the subjacent side edge of the driven pile for threading the side edge of the undriven pile onto the side edge of the fixed driven pile. The accurate positioning and alignment of the side edges of the adjacent sheet piles for threading or stabbing eliminates the necessity of a workman being present adjacent the upper end of the driven pile thereby avoiding a possible safety hazard. It is important that the sheet piles be accurately aligned for registering of the interfitting side edges for threading so that a workman at a ground location below the raised undriven pile can easily move the undriven pile into accurate vertical alignment with the adjacent side edge of the driven pile.

SUMMARY OF THE INVENTION

The present invention is directed generally to improvements in a pile threading device such as shown in U.S. Pat. No. 5,407,304 in which opposed rollers engage opposed sides of a fixed driven pile for guiding the pile threading device, and opposed jaws on a horizontal slide member grip the undriven pile for raising of the pile threading by the undriven pile device from a lower ground surface. The opposed jaws on the slide of the pile threading device are moved into gripping relation against opposed sides of the undriven pile. Then, the undriven pile along with the pile threading device are raised by an overhead crane or the like relative to the fixed driven pile until the lower end of the undriven pile clears the upper end of the driven pile. In this position, a workman at ground level actuates a lever to move the slide along with the gripped undriven pile laterally so that the adjacent side edges of the driven and undriven piles are vertically aligned and registered for threading of the undriven pile onto the driven pile.

For accurate alignment of the undriven pile with the fixed driven pile, it is necessary that the jaws on the slide of the threading device grip opposed sides of the undriven pile at a predetermined position. Sheet metal piles may be of a Z-shape or channel shape in which two generally Z-shaped piles have been previously secured. The piles may be of different thicknesses also. Opposed roller frames are mounted on opposed sides of the fixed driven pile and rollers thereon contact opposed surfaces of the fixed pile in a tight relation. Sometimes it may be desirable to have the set point for the undriven pile at the front surface of the fixed sheet pile and other times it is desirable to have the set point for the undriven pile at the rear surface of the fixed driven pile. Thus, the jaws that grip opposed surfaces of the undriven sheet pile are adjustable so that a selected jaw may remain in a fixed predetermined position for positioning the undriven pile while the other opposed jaw is movable into gripping relation with the undriven pile. For that purpose an adjustable stop member for each of the jaws is provided to permit either of the pair of jaws to be positioned at a predetermined fixed relation.

Also, it is desirable that the adjacent side edge of the undriven sheet pile be accurately positioned on the slide when the undriven sheet pile is initially positioned between the jaws for subsequent gripping. For that purpose, a stop is provided on the slide for contacting the side edge of the undriven sheet pile when the undriven sheet pile is placed between the jaws of the slide. Another stop is carried by the slide to contact the side edge of the driven pile when the slide and undriven pile are moved laterally upon the lower end of the undriven pile clearing the upper end of the driven pile in a raised position for vertical alignment of the side edge of the undriven pile and the subjacent side edge of the driven pile.

Another feature of the present invention includes shock absorber or cushioning means to permit the roller frames to move away from each other a limited amount during upward travel of the pile threading device along the driven pile. Debris, ice, or other material may adhere to the flat surfaces of the driven pile and if lateral movement of the roller frames is not permitted, the roller frames or roller shafts may be overstressed and possibly bent or fractured. Thus, it is desirable that a limited movement of the roller frames away from each other be permitted. For this purpose, a slidable roller frame is mounted on an actuating shaft and a coil spring about the shaft urges the movable roller frame into contact with the pile to permit movement of the opposed roller frames away from each other.

Other features and advantages of the invention will be apparent from the following specification and drawings.

DESCRIPTION OF THE INVENTION

Figure 1:
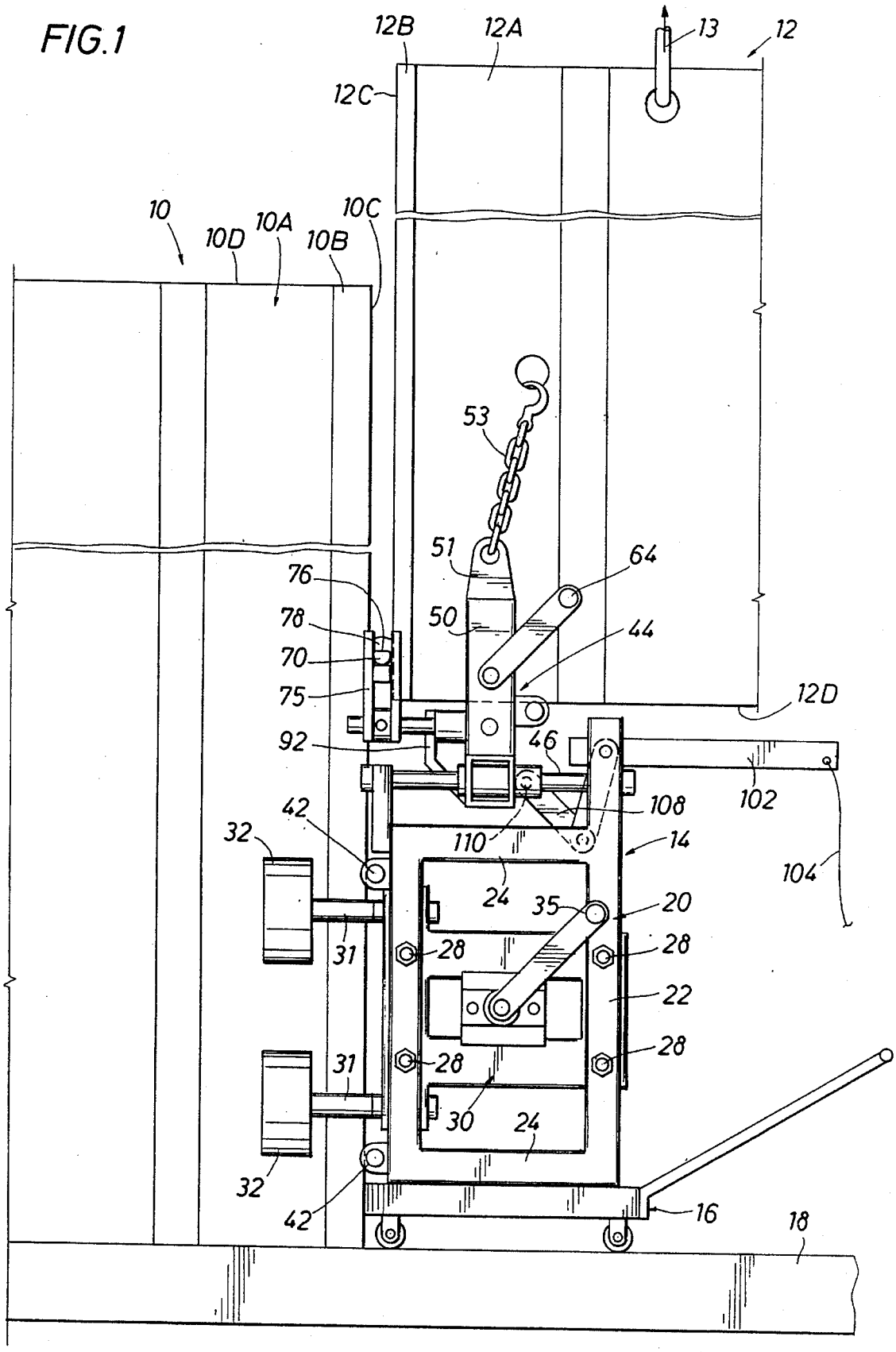
FIG. 1 is a side elevation of the pile threading device of the present invention shown mounted on a supporting dolly with guiding side rollers in engagement with a driven pile and with opposed jaws on an upper slide gripping the lower end of an undriven pile for being raised with the undriven pile.
Figure 2:
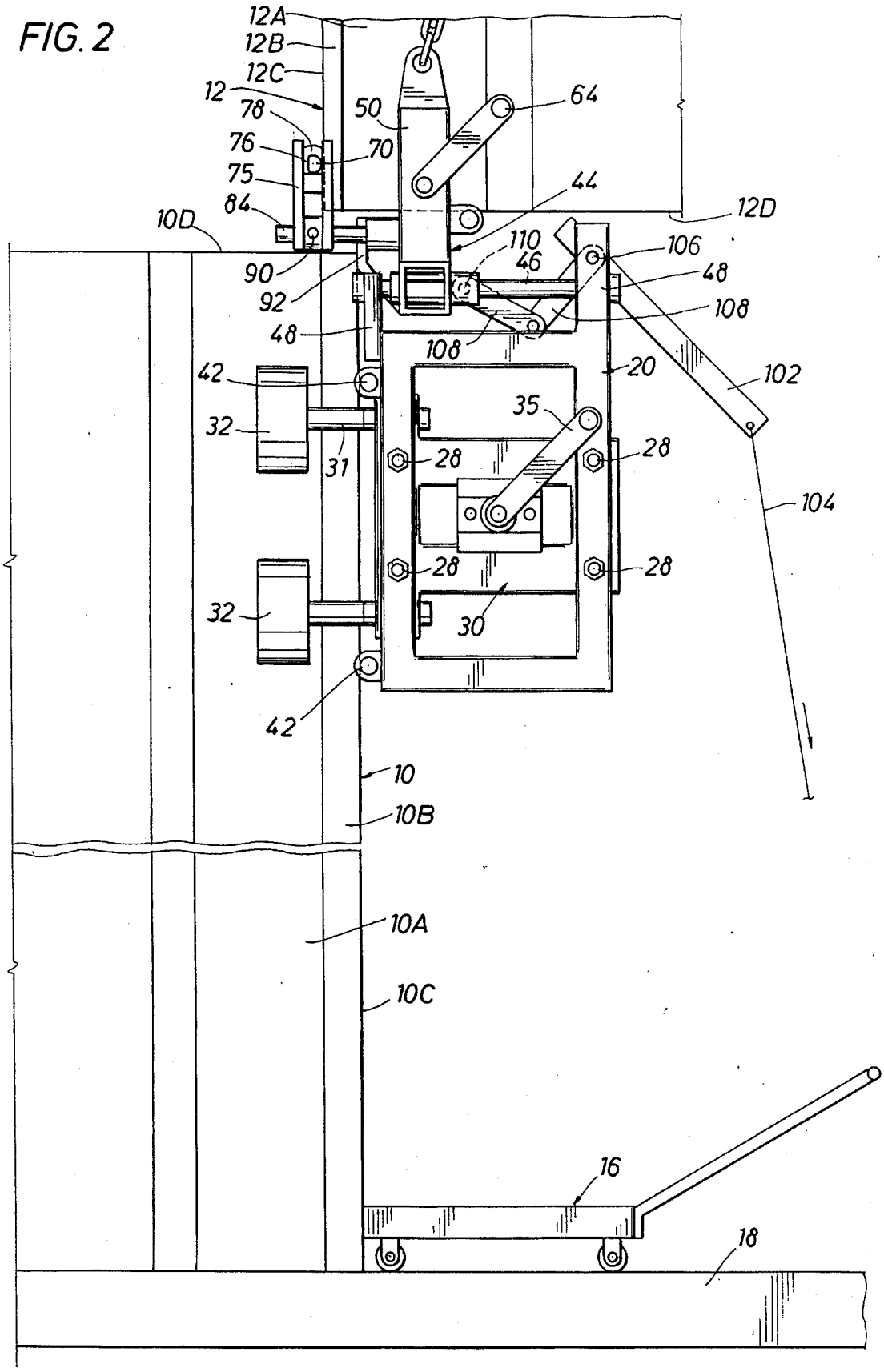
FIG. 2 is a side elevation similar to FIG. 1 but showing the pile threading device and undriven pile raised above the fixed driven pile with the slide and gripped lower end of the raised pile moved laterally into vertically aligned position by manual actuation of a lever cable with stops on the slide engaging side edges of the fixed driven pile and the undriven pile.

Referring to the drawings for a better understanding of the invention, and more particularly to FIGS. 1–2, a previously driven pile is illustrated generally at 10. Pile 10 is illustrated as a pair of Z-shaped pile sections which have been previously connected at a tongue and groove connection. A side flange 10A of pile 10 has a side edge portion defining a groove 10B and side edge 10C. It is desired that an undriven pile illustrated generally at 12 be interlocked with driven pile 10. Undriven pile 12 has a side flange 12A and the adjacent side edge portion defines a tongue 12B and side edge 12C. Tongue 12B is adapted to fit within groove 10B when aligned vertically with groove 10B and lowered into interlocking relation. Groove 10B and tongue 12B define female and male interlocking edges. For interlocking of sheet piles 10 and 12 it is necessary to raise the undriven pile 12 a hook 13 from an overhead crane (not shown) until the lower end 12D of pile 12 clears the upper end 10D of driven pile 10. Then, pile 12 is shifted or moved laterally a predetermined distance until tongue 12B is in vertical alignment with groove 10B. In this position pile 12 may be lowered to provide an interlocking of groove 10B and tongue 12B. It is to be understood that this invention may be utilized with various pile sections which utilize interlocking side edges.

The present invention is directed to a pile threading device generally indicated at 14 and supported on a wheeled platform or dolly 16 for movement along horizontal beams 18 toward and away from free edge 10C of driven pile 10. Pile threading device 14 includes a box-type frame or body 20 which comprises a plurality of frame members welded to each other. Four vertical frame members 22 are connected at their lower ends by lower horizontal frame members 24 and at their upper ends by upper horizontal frame members 26. Four horizontal shafts 28 are secured between a pair of vertical frame members 22.

Figure 3:
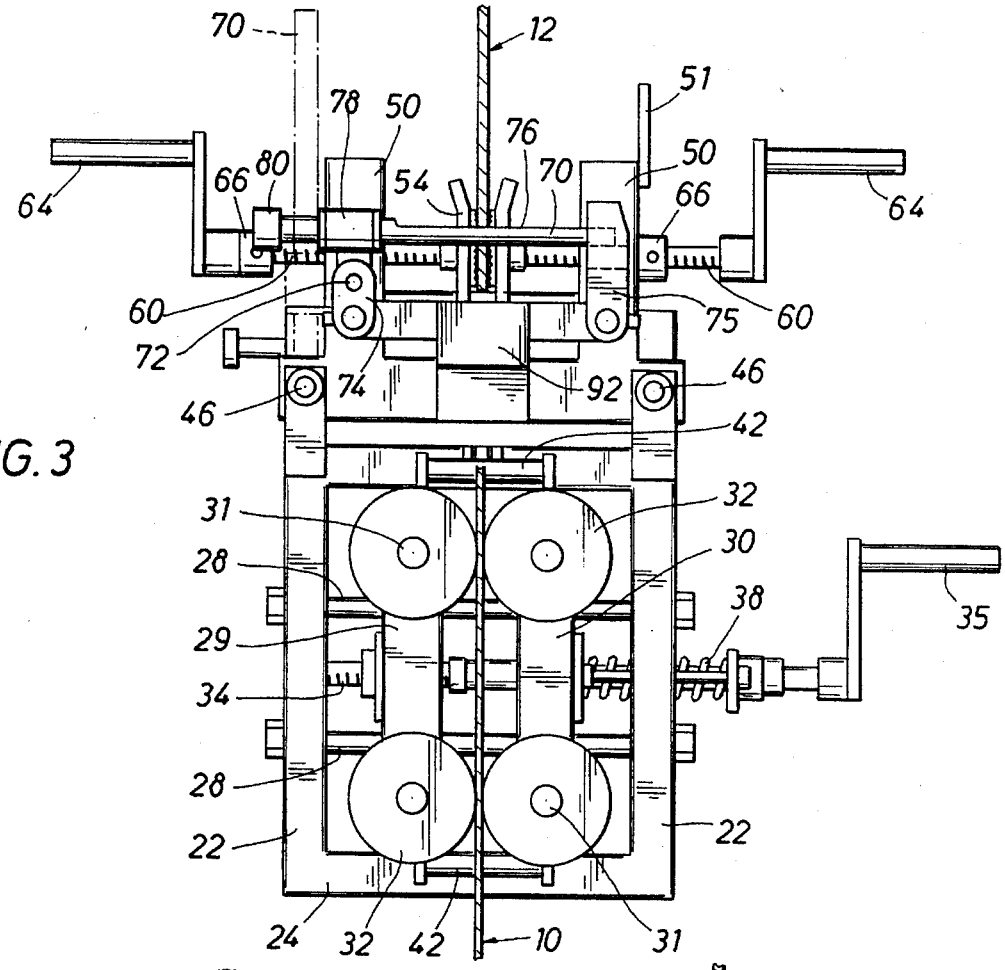
FIG. 3 is a side elevation of the pile threading device shown in FIGS. 1 and 2 with jaws gripping the undriven sheet pile and rollers engaging opposed sides of the driven sheet pile.
Figure 4:
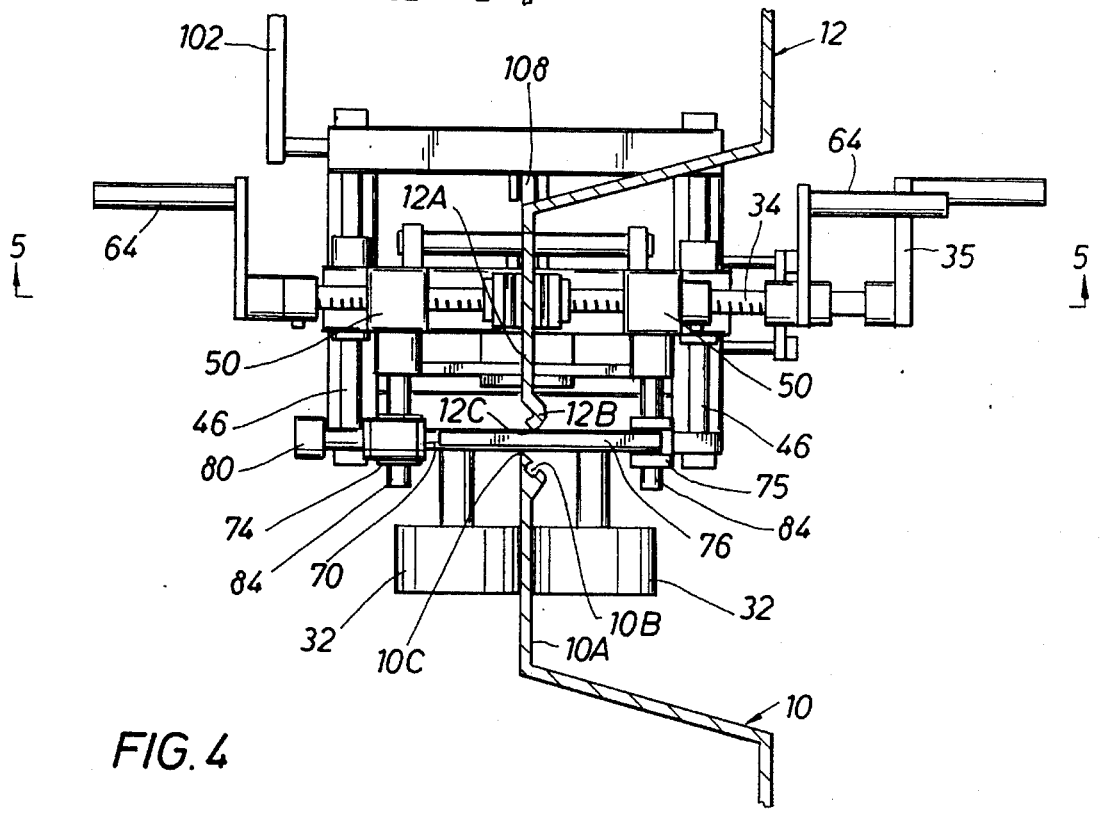
FIG. 4 is a top plan of the pipe threading device shown in FIG. 3 with the undriven pile gripped by jaws on the slide and contacting a stop on the slide.
Figure 5:
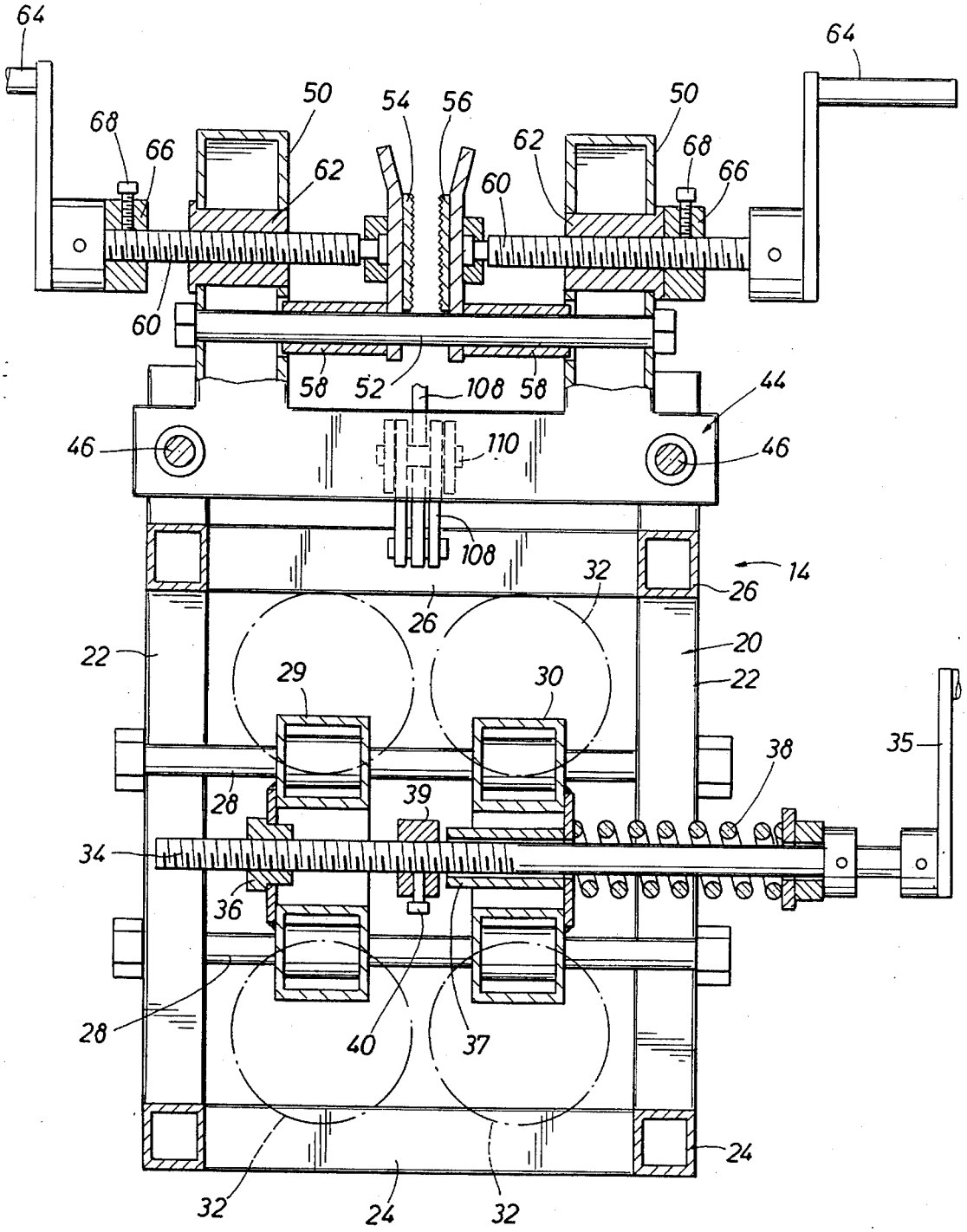
FIG. 5 is an enlarged section taken generally along line 5—5 of FIG. 4 and showing means for positioning jaws at a predetermined position and means for cushioning lateral movement of the rollers.

Threading device 14 is adapted for engaging and riding along driven pile 10 while undriven pile 12 is being raised thereby to guide pile 12 in a vertical direction closely spaced from the adjacent driven pile 10. A pair of opposed roller frames 29, 30 each has a pair of shafts 31 with rollers 32 mounted thereon for rotation. Roller frame 29 is adapted to be positioned on one side of driven pile 10 and roller frame 30 is adapted to be positioned on an opposed side of driven pile 10 with associated rollers 32 in contact with opposed sides of driven pile 10. Roller frames 29, 30 are mounted on shafts 28 for sliding movement. As shown particularly in FIG. 5, an externally threaded shaft 34 has a hand crank 35 on an extending end. Roller frame 29 has an internally threaded sleeve 36 threaded on shaft 34. Roller frame 30 has a sleeve 37 receiving shaft 34 and a spring 38 about shaft 34 urges roller frame 30 toward a stop 39 adjustably mounted on shaft 34 by a set screw 40. In a normal operating position of roller frame 30 as shown in FIGS. 3 and 5 with rollers 32 engaging driven pile 10, sleeve 37 is spaced from stop 39 and spring 38 is compressed slightly. Roller frame 30 and rollers 32 thereon may move laterally against the bias of spring 38 in the event of uneven surfaces on the sides of driven pile 10. An uneven surface may be obtained, for example, by debris or ice adhering to the sides of the pile 10. Thus, roller frame 30 and spring 38 act as a shock absorber to minimize stresses exerted against rollers 32 on roller frames 29 and 30. Upper and lower bearing sleeves or rollers 42 on frame 20 engage edge 10C of fixed pile 10 for guiding threading device 14 when lifted by pile 12 particularly as shown in FIG. 1. Rotation of hand crank 35 will provide the desired spacing between stop 39 and roller frame 30 as shown in FIG. 5.

Pile threading device 14 has a horizontally movable slide generally indicated at 44 mounted for sliding movement along a pair of parallel rods 46 secured between upper extensions 48 of body 20. Slide 44 includes a pair of jaw supports comprising upwardly extending arms 50 having a rod 52 secured therebetween. Each arm 50 has an upper tab 51 connected to a chain 53 for hooking pile 12 in a safety connection. A pair of opposed jaws 54, 56 each has a lower sleeve 58 mounted on rod 52 for sliding movement. An externally threaded shalt 60 for each jaw 54, 56 is threaded within an internally threaded bushing 62 on each arm 50 and a manual crank 64 is secured to the outer end of each shaft 60 for rotation of shaft 60 and movement of the associated gripping jaw 54 or 56 thereon. It is desirable in order to set undriven pile 12 accurately relative to fixed driven pile 10 that one of the jaws 54, 56 be set or fixed at a predetermined position with the other jaw 54, 56 movable for gripping pile 12 therebetween. For example, if the driven pile comprises a single Z-shaped pile, the set point would alternate between the front side of one pile and the rear side of a subsequent pile. For this purpose, an adjustable stop 66 comprises a nut mounted on each shaft 60 and may be adjusted by set screw 68 to a predetermined position. As shown in FIG. 5, jaw 56 is positioned at a predetermined position relative to fixed pile 10 and associated stop 66 has been preadjusted. The undriven pile 12 is gripped by movement of jaw 54 toward set jaw 56. Jaw 54 could, if desired, have its associated stop 66 adjusted for positioning at a desired location with jaw 56 being movable for gripping pile 12.

For accurate alignment of pile 12 with pile 10 for threading, it is necessary that undriven pile 12 be positioned between jaws 54, 56 at a precise lateral position. For this purpose, a stop bar 70 as shown in FIG. 3 is pivoted at 72 to a U-shaped arm 74 secured to slide 44 and another U-shaped arm 75 secured to slide 44 receives an opposite end of stop bar 70 in supporting relation. Bar 70 has a flat side 76 and may be rotated within sleeve 78 to position flat side 76 on the upper surface of rod 70 as shown in FIG. 1, or on the side surface of rod 70 as shown in FIG. 2. A weight 80 is provided on an end of rod 70 to assist in pivoting of rod 70 to a vertical position and to maintain rod 70 in a vertical position. To adjust the position of rod 70 relative to jaws 54, 56 on slide 44, a pair of horizontal pins 84 secured to slide 44 receive U-shaped arms 74, 75 thereon. A set screw 90 on U-shaped arms 74, 75 permits arms 74, 75 to be adjustably positioned on pins 84. Upon initial positioning of pile 12 for gripping between jaws 54, 56, edge 12C contacts stop bar 70 in the position of FIG. 1 with flat 76 on the upper surface of bar 70 and with lateral movement of stop bar 70 restricted between the arm portions of U-shaped arm 75. After gripping of pile 12 between jaws 54, 56, rod 70 is manually rotated within sleeve 78 to the position of FIG. 2 in which a limited lateral movement of stop bar 70 is permitted between arm portions of arm 75. This provides a tolerance for pile 12 to permit a slight movement of edge 12C during the initial threading of pile 12 onto pile 10.

A separate stop is shown at 92 on slide 44 for positioning undriven pile 12 accurately relative to lower driven pile 10 upon actuation and lateral movement of slide 44 together with pile 12. As shown in FIG. 2 after lateral movement of slide 44, stop 92 contacts edge 10C of pile 10 to block further lateral movement of slide 44 and pile 12. Stop bar 70 in the position shown in FIG. 2 permits a slight movement of pile 12 for initial alignment and threading of piles 10 and 12. Upon lowering of undriven pile 12 from the position of FIG. 2, upper end 10D of pile 10 contacts stop bar 70 and pivots stop bar 70 to an upright position as shown in broken lines in FIG. 3.

For movement of slide 44, a lever 102 has a cable or rope 104 extending to the ground or supporting surface for actuation of lever 102 by a workman. Lever 102 is pivotably connected at 106 to body 20. Links 108 between lever 102 and slide 44 are connected to slide 44 at 110 for movement of slide 44 along rods 46 upon actuation of lever 102.

In operation, threading device 14 is positioned on dolly 16 and manually moved to engagement with side edge 10C of driven pile 10 in which roller frames 29 and 30 are on opposite sides of driven pile 10. In this position, hand crank 35 is rotated manually to rotate shaft 34 and to move roller frames 29, 30 and rollers 32 into engagement with opposite sides of driven pile 10. Next, undriven pile 12 is lowered by an overhead crane (not shown) to the position shown in FIG. 1 with clamping jaws 54, 56 in an open position and stop bar 70 in an operable horizontal position. Jaw 56 has been set as the fixed jaw and the associated stop 66 has been positioned at a predetermined location on shaft 60 for accurately positioning undriven pile 12 with respect to the front side of driven pile 10. The lower end 12D of pile 12 is supported on slide 44 between clamping jaws 54, 56 and edge 12C is positioned in abutting contact with stop bar 70. In this position, hand crank 64 of movable jaw 54 is actuated to move movable jaw 54 toward jaw 56 into tight gripping contact with undriven pile 12 for clamping of undriven pile 12 tightly between jaws 54, 56. Safety chain 53 on slide 44 is engaged with pile 12 in the event of the release of pile 12 by jaws 54, 56. Stop bar 70 is manually rotated to the position shown in FIG. 2 to position flat 76 on a side of bar 70.

Next, pile 12 is lifted by the overhead crane along with pile threading device 14 gripped by clamping jaws 54, 56. Bearing guides 42 guide the upward vertical movement of threading device 14 and undriven pile 12 by contact against edge 10C of fixed pile 10. In the event rollers 32 engage surface debris, or the like on pile 10, roller frame 30 and associated rollers 32 move outwardly against spring 38 thereby to act as a shock absorber for rollers 32. When the lower end 12D of undriven pile 12 clears the upper end 10D of driven pile 10 as shown in FIG. 2, a workman pulls cable 104 to move lever 102 downwardly for actuation of links 108 and movement of slide 44 and pile 12 laterally along rods 46 until stop 92 engages edge 10C on pile 10. In this position, pile 12 is lowered by the overhead crane along with threading device 14 with tongue 12B being threaded or stabbed into grooves 10B. Side edge 12C may move or pivot slightly, such as ⅛ inch, against pivot rod 70 when stabbing of tongue 12B first occurs. Upon lowering of pile 12, pivot rod 70 is contacted by upper edge 10D of pile 10 to pivot rod 70 to an upright position. After threading of tongue 12B within groove 10B, pile 12 is lowered until threading device 14 is again supported on dolly 16. In this position, crank 64 is rotated to move jaws 54 and 56 from gripping engagement with driven pile 10. Then, hand crank 35 is rotated to remove rollers 32 out of engagement with pile 10. Chain 53 may then be released from pile 12. Then, dolly 16 along with threading device 14 may be moved manually from beneath undriven pile 12 to a remote location. Pile 12 is then lowered onto the ground for subsequent driving into the formation by a suitable pile driver or the like. Then, another sequence may be commenced with a new undriven pile.

For further details of the pile threading device, reference is made to U.S. Pat. No. 5,407,304 issued Apr. 18, 1995, the entire disclosure of which is incorporated by this reference.

While a preferred embodiment of the present invention has been illustrated in detail, it is apparent that modifications and adaptations of the preferred embodiment will occur to those skilled in the art. However, it is to be expressly understood that such modifications and adaptations are in the spirit and scope of the present invention as set forth in the following claims.

What is claimed is:

1. A pile threading device adapted to support an undriven pile thereon and to guide the undriven pile vertically along a driven pile as the undriven pile is lifted along the driven pile, the driven and undriven piles having male and female side edges adapted to be interlocked; said threading device comprising:

a body;

a pile supporting slide mounted on said body for relative sliding movement in a generally horizontal direction;

a plurality of rollers mounted on said body for movement toward and away from each other on opposed sides of said driven pile;

means on said slide to clamp said undriven pile including a pair of opposed jaws movable toward and away from each other for clamping said undriven pile therebetween adjacent a side edge of said undriven pile;

a stop on said slide engaging said side edge when said undriven pile is positioned between said jaws for positioning said undriven pile at a predetermined horizontal position on said slide;

and means mounting said stop for movement to a position out of contact with said side edge of said undriven pile.

2. A pile threading device as set forth in claim 1 wherein:

means on said slide mount said stop for horizontal adjusting movement relative to said jaws.

3. A pile threading device as set forth in claim 2 wherein:

said stop comprises a bar on said slide mounted for pivotal movement about a horizontal axis between engaged and disengaged position with said side edge of said undriven pile.

4. A pile threading device as set forth in claim 1 wherein:

said stop comprises a rod having a flat surface on a side thereof, and means mount said rod for rotative movement about its longitudinal axis to position said flat surface at a desired location.

5. A pile threading device as set forth in claim 1 wherein:

means are provided to move said slide selectively in a direction toward said side edge of said driven pile; and a second stop is mounted on said slide for contacting said side edge of said driven pile to stop the movement of said slide when moved horizontally.

6. A pile threading device adapted to support an undriven pile thereon and to guide the undriven pile vertically along a driven pile as the undriven pile is lifted along the driven pile, the driven and undriven piles having male and female side edges adapted to be interlocked; said threading device comprising:

a body;

a pile supporting slide mounted on said body for relative sliding movement in a horizontal direction;

a pair of opposed vertically extending jaw supports on said slide;

an externally threaded rotatable shaft supported on each of said jaw supports;

a pile gripping jaw mounted on an extending end of each shaft; and an adjustable stop for each shaft to limit selectively the movement of the associated jaw so that said associated jaw may be set at a predetermined position on said slide.

7. A pile threading device as set forth in claim 6 wherein:

said adjustable stop comprises an internally threaded nut on an associated shaft for adjustable movement along said shaft, said nut abutting said jaw support when in set position.

8. A pile threading device as set forth in claim 6 wherein:

a rod is secured between said opposed jaw supports; and a sleeve secured to each jaw is mounted on said rod for sliding movement.

9. A pile threading device as set forth in claim 6 wherein:

a hand crank is mounted on an extending end of each shaft opposite the associated jaw for rotation of said shaft and movement of the jaw back and forth.

10. A pile threading device engaging opposed sides of a driven sheet pile adjacent a front side edge of the driven sheet pile and connected to an undriven sheet pile for guiding vertical movement of the undriven sheet pile alongside the driven sheet pile; said pile threading device comprising:

a supporting body including a plurality of connected frame members including vertical frame members;

a pair of opposed roller frames carried by said supporting body, each roller frame having a pair of vertically spaced rollers thereon for contacting an adjacent side of the fixed sheet pile;

a plurality of slide rods extending between a pair of said vertical frame members and mounting said roller frames for sliding horizontal movement thereon;

an externally threaded shaft connected to said roller frames, one of said roller frames engaging said shaft in threaded relation and the other of said roller frames mounted on said shaft for relative sliding movement; and spring means urging said other roller frame and rollers thereon into an engaged relation with the adjacent side of said driven sheet pile and permitting a cushioned movement of said roller frames away from each other.

11. A pile threading device as set forth in claim 10 wherein:

an adjustable stop is threaded onto said externally threaded shaft for limiting sliding movement of said other roller frame toward said one roller frame.

12. A pile threading device as set forth in claim 11 wherein:

said spring means comprises a coil spring about said shaft biased against said other roller frame and permitting a cushioned movement of said roller frames away from each other when traveling along opposed sides of said driven pile.

* * * * *